US011560611B2

(12) United States Patent
Burton et al.

(10) Patent No.: US 11,560,611 B2
(45) Date of Patent: Jan. 24, 2023

(54) CUTTING TOOL WITH PCD INSERTS, SYSTEMS INCORPORATING SAME AND RELATED METHODS

(71) Applicant: US SYNTHETIC CORPORATION, Orem, UT (US)

(72) Inventors: Regan Leland Burton, Saratoga Springs, UT (US); Dan Bagley, Hidden Valley, PA (US); Ken Jensen, Mapleton, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 324 days.

(21) Appl. No.: 16/529,176

(22) Filed: Aug. 1, 2019

(65) Prior Publication Data

US 2020/0040434 A1 Feb. 6, 2020

Related U.S. Application Data

(60) Provisional application No. 62/713,862, filed on Aug. 2, 2018.

(51) Int. Cl.
*C22C 26/00* (2006.01)

(52) U.S. Cl.
CPC ..... *C22C 26/00* (2013.01)

(58) Field of Classification Search
CPC ..... C22C 26/00; C22C 2001/1073; B22F 2005/001; B23B 27/1607; B23B 27/1611; B23B 27/143; B23B 27/145; B23B 2210/06; B23B 27/148; B23B 2226/315; Y10T 407/27
USPC ..... 407/119
See application file for complete search history.

(56) References Cited

U.S. PATENT DOCUMENTS

| | | | |
|---|---|---|---|
| 5,303,787 | A | 4/1994 | Brady |
| 5,429,199 | A | 7/1995 | Sheirer et al. |
| 7,866,418 | B2 | 1/2011 | Bertagnolli et al. |
| 8,297,382 | B2 | 10/2012 | Bertagnolli et al. |
| 8,783,380 | B1 | 7/2014 | Bertagnolli et al. |

(Continued)

FOREIGN PATENT DOCUMENTS

| | | | |
|---|---|---|---|
| EP | 1190791 | B1 | 6/2010 |
| WO | 2018147959 | A1 | 8/2018 |

OTHER PUBLICATIONS

Manufacturing Guide, "Chip Breaking", Accessed 2021 (Publication date unavailble) (Year: 2021).*

(Continued)

*Primary Examiner* — Archene A Turner
(74) *Attorney, Agent, or Firm* — Dorsey & Whitney LLP

(57) ABSTRACT

A cutting tool which may be used in machining various material may include a body and one or more cutting elements associated therewith. In one example, the cutting element(s) may comprise a superhard table, such as a polycrystalline diamond table. In some embodiments, the polycrystalline diamond table may have a diamond density of approximately 95 percent volume or greater. In some embodiments, the thickness of the superhard table may be approximately 0.15 inch. In some embodiments, the superhard table may include a chip breaking feature or structure. Methods of shaping, finishing or otherwise machining materials are also provided, including the machining of materials comprising titanium.

23 Claims, 12 Drawing Sheets

(56) References Cited

U.S. PATENT DOCUMENTS

| | | | | |
|---|---|---|---|---|
| 9,062,505 | B2 | 6/2015 | Crockett et al. | |
| 9,080,385 | B2 | 7/2015 | Sexton et al. | |
| 9,089,900 | B2 | 7/2015 | Kountanya et al. | |
| 9,278,395 | B2 | 3/2016 | Matsuo et al. | |
| 9,315,881 | B2 | 4/2016 | Linford et al. | |
| 9,403,260 | B1 | 8/2016 | Adams et al. | |
| 9,771,760 | B2 | 9/2017 | Cox et al. | |
| 10,060,192 | B1 * | 8/2018 | Miess | E21B 10/5735 |
| 10,280,687 | B1 * | 5/2019 | Mukhopadhyay | B24D 18/0009 |
| 10,392,866 | B2 | 8/2019 | Cox et al. | |
| 10,400,516 | B2 | 9/2019 | Cox | |
| 10,408,057 | B1 | 9/2019 | Myers et al. | |
| 2010/0028098 | A1 | 2/2010 | Shaffer | |
| 2010/0221077 | A1 * | 9/2010 | Nash | B23G 5/06 408/1 R |
| 2010/0300767 | A1 * | 12/2010 | Cariveau | C04B 35/52 175/432 |
| 2011/0088950 | A1 * | 4/2011 | Scott | B24D 18/0009 175/57 |
| 2011/0171414 | A1 * | 7/2011 | Sreshta | E21B 10/00 428/64.1 |
| 2012/0103700 | A1 * | 5/2012 | Lin | E21B 10/5673 175/428 |
| 2012/0138370 | A1 * | 6/2012 | Mukhopadhyay | B24D 3/10 175/428 |
| 2014/0144712 | A1 * | 5/2014 | Lund | B24D 99/005 175/428 |
| 2014/0239051 | A1 | 8/2014 | Barry et al. | |
| 2014/0318873 | A1 * | 10/2014 | Patel | E21B 10/567 175/432 |
| 2014/0348452 | A1 | 11/2014 | Gonzalez et al. | |
| 2015/0041225 | A1 * | 2/2015 | Jonker | E21B 10/56 175/434 |
| 2015/0151362 | A1 | 6/2015 | Olofsson et al. | |
| 2016/0230473 | A1 * | 8/2016 | Davies | C22C 29/08 |
| 2018/0371846 | A1 * | 12/2018 | Matsuo | B23B 27/20 |
| 2019/0084087 | A1 | 3/2019 | Chapman et al. | |
| 2020/0001374 | A1 * | 1/2020 | Farrarons Mallen | B23C 5/006 |

OTHER PUBLICATIONS

International Search Report and Written Opinion from International Application No. PCT/US2019/44666 dated Oct. 29, 2019.
U.S. Appl. No. 15/232,780, filed Aug. 9, 2016.
U.S. Appl. No. 62/713,862, filed Aug. 2, 2018.
Extended European Search Report dated Mar. 7, 2022 received in European Patent App. No. 19845426.6.

* cited by examiner

CUTTING TOOL WITH PCD INSERTS, SYSTEMS INCORPORATING SAME AND RELATED METHODS

This application claims the benefit of U.S. Provisional Patent Application No. 62/713,862, filed on Aug. 2, 2018, entitled CUTTING TOOL WITH PCD INSERTS, SYSTEMS INCORPORATING SAME AND RELATED METHODS, the disclosure of which is incorporated by reference herein in its entirety.

BACKGROUND

Cutting tools are conventionally used in machining operations to remove material and form desired shapes and surfaces of a given object. For example, milling is a machining process wherein material is progressively removed in the form of "chips" to form a shape or surface from a given volume of material—often referred to as a workpiece. This may be accomplished by feeding the work piece into a rotating cutting tool (or vice-versa), often in a direction that is perpendicular to the axis of rotation of the cutting tool. Various types of cutters may be employed in milling operations, but most cutting tools include a body and one or more teeth (or cutting elements—which may be brazed or mechanically attached to the body) that cut into and remove material from the workpiece as the teeth of the rotating cutter engage the workpiece.

Nearly any solid material may be machined, including metals, plastics, composites and natural materials. Some materials are more easily machined than other types of materials, and the type of material being machined may dictate, to a large extent, the process that is undertaken to machine the workpiece, including the choice of cutting tool. For example, titanium and titanium alloys, while exhibiting a number of desirable mechanical and material characteristics, are notoriously difficult to machine.

While there are numerous reasons for the difficulty in milling titanium materials, some of them not entirely understood, some reasons may include its high strength, chemical reactivity with cutter materials, and low thermal conductivity. These characteristics tend to reduce the life of the cutter. Additionally, the relatively low Young's modulus of titanium materials is believed to lead to "chatter" in the cutting tool, often resulting in a poor surface finish of a machined workpiece. Further, the "chips" that are typically formed in machining processes such as milling are not typically small broken chips but, rather, long continuous chips which can become tangled in the machinery, posing a safety hazard and making it difficult to conduct automatic machining of titanium materials.

While there have been various attempts to provide cutting tools that provide desirable characteristics for machining various materials, including normally difficult-to-machine materials such as titanium, there is a continued desire in the industry to provide improved cutting tools for machining of a variety of materials and for use in a variety of cutting processes.

SUMMARY

Embodiments of the invention relate to cutting tools that may be used in the machining of various materials. In accordance with one embodiment, a cutting tool comprises a body and at least one cutting element associated with the body, the at least one cutting element comprising a superhard table exhibiting a thickness of at least approximately 0.15 inches, wherein the superhard table includes a chip breaking feature.

In one embodiment, the superhard table comprises polycrystalline diamond.

In one embodiment, the superhard table exhibits a density of at least 95 volume percent of polycrystalline diamond.

In one embodiment, superhard table exhibits a density of at least 98 volume percent of polycrystalline diamond.

In one embodiment, the table is not bonded to a substrate.

In one embodiment, the polycrystalline diamond exhibits an average grain size of approximately 12 μm or less. Additionally, a metal-solvent catalyst may be present in at least some interstitial regions of the polycrystalline diamond in an amount greater than approximately 7 percent by weight. In one embodiment, the metal-solvent catalyst comprises cobalt.

In one embodiment, the polycrystalline diamond exhibits an average grain size of approximately 20 μm or greater. Additionally, a metal-solvent catalyst may be present in at least some interstitial regions of the polycrystalline diamond in an amount less than approximately 7 percent by weight. In one embodiment, the metal-solvent catalyst comprises cobalt.

In one embodiment, the table exhibits a thickness of at least approximately 0.2 inches.

In one embodiment, the table comprises a polycrystalline diamond table having: a plurality of diamond grains exhibiting diamond-to-diamond bonding therebetween and defining a plurality of interstitial regions; a metal-solvent catalyst occupying at least a portion of the plurality of interstitial regions, wherein the plurality of diamond grains and the metal-solvent catalyst collectively exhibit a coercivity of about 115 Oersteds ("Oe") to about 175 Oe; and wherein the plurality of diamond grains and the metal-solvent catalyst collectively exhibit a specific magnetic saturation of about 10 Gauss $cm^3$/grams ("G·$cm^3$/g") to about 15 G·$cm^3$/g.

In one embodiment, the body comprises aluminum.

In accordance with another embodiment of the disclosure, a method is provided for removing material from a workpiece. The method comprises: providing a cutting tool, the cutting tool comprising a body, and at least one cutting element associated with the body, the at least one cutting element comprising a superhard table having a thickness of 0.07 inch or greater; rotating the cutting tool about an axis; and engaging a workpiece with rotating cutting tool.

In one embodiment, engaging a workpiece includes engaging a workpiece comprising titanium.

In one embodiment, providing the cutting element comprising a superhard table includes sintering a volume of diamond particles a high-pressure, high-temperature (HPHT) to form a plurality of diamond grains exhibiting diamond-to-diamond bonding therebetween.

In one embodiment, sintering a volume of diamond particles includes infiltrating at least some interstitial spaces between the diamond grains with a metal-solvent catalyst.

In one embodiment, the method further includes forming a catalyst depleted region in the table by removing at least some of the metal-solvent catalyst from interstitial spaces.

In one embodiment, infiltrating at least some interstitial spaces between the diamond grains with a metal-solvent catalyst includes infiltrating with a cobalt material.

In one embodiment, providing the table includes providing a volume of polycrystalline diamond that exhibits an average grain size of approximately 12 μm or less and wherein a metal-solvent catalyst is present in at least some interstitial regions of the polycrystalline diamond in an amount greater than approximately 7 percent by weight.

In one embodiment, providing the table includes providing a volume of polycrystalline diamond that exhibits an average grain size of approximately 20 μm or greater and wherein a metal-solvent catalyst is present in at least some interstitial regions of the polycrystalline diamond in an amount less than approximately 7 percent by weight.

In one embodiment, providing the cutting element comprising a superhard table includes providing a table that exhibits a thickness of at least 0.2 inches.

In one embodiment, providing the cutting element comprising a superhard table includes providing a polycrystalline diamond table that exhibits approximately 95 volume percent diamond or greater.

In one embodiment, providing the cutting element comprising a superhard table includes providing a chip breaking feature in the superhard table.

In accordance with another embodiment, a cutting tool comprising a body, at least one cutting element associated with the body, the at least one cutting element consisting essentially of a polycrystalline diamond table exhibiting a thickness of at least approximately 0.15 inch.

In one embodiment, the at least one cutting element is formed of a material comprising at least approximately 95 volume percent diamond.

In one embodiment, the diamond table is at least approximately 98 volume percent diamond.

In one embodiment, the diamond table exhibits a thickness of at least approximately 0.2 inch.

In accordance with one embodiment, a cutting element is provided consisting essentially of: a superhard table exhibiting a thickness of at least approximately 0.15 inches, wherein the superhard table includes a chip breaking feature.

Various elements, components, features or acts of one embodiment described herein may be combined with elements, components, features or acts of other embodiments without limitation.

BRIEF DESCRIPTION OF THE DRAWINGS

The drawings illustrate various embodiments of the invention, wherein common reference numerals refer to similar, but not necessarily identical, elements or features in different views or embodiments shown in the drawings.

DETAILED DESCRIPTION

Embodiments of the disclosure relate to cutting tools that may be used in machining processes, including milling, drilling, turning as well as variations and combinations thereof. The cutting tools may be used in shaping, forming and finishing a variety of different materials, including materials that are often difficult to machine, including, for example, titanium, titanium alloys and nickel based materials.

Figure 1:
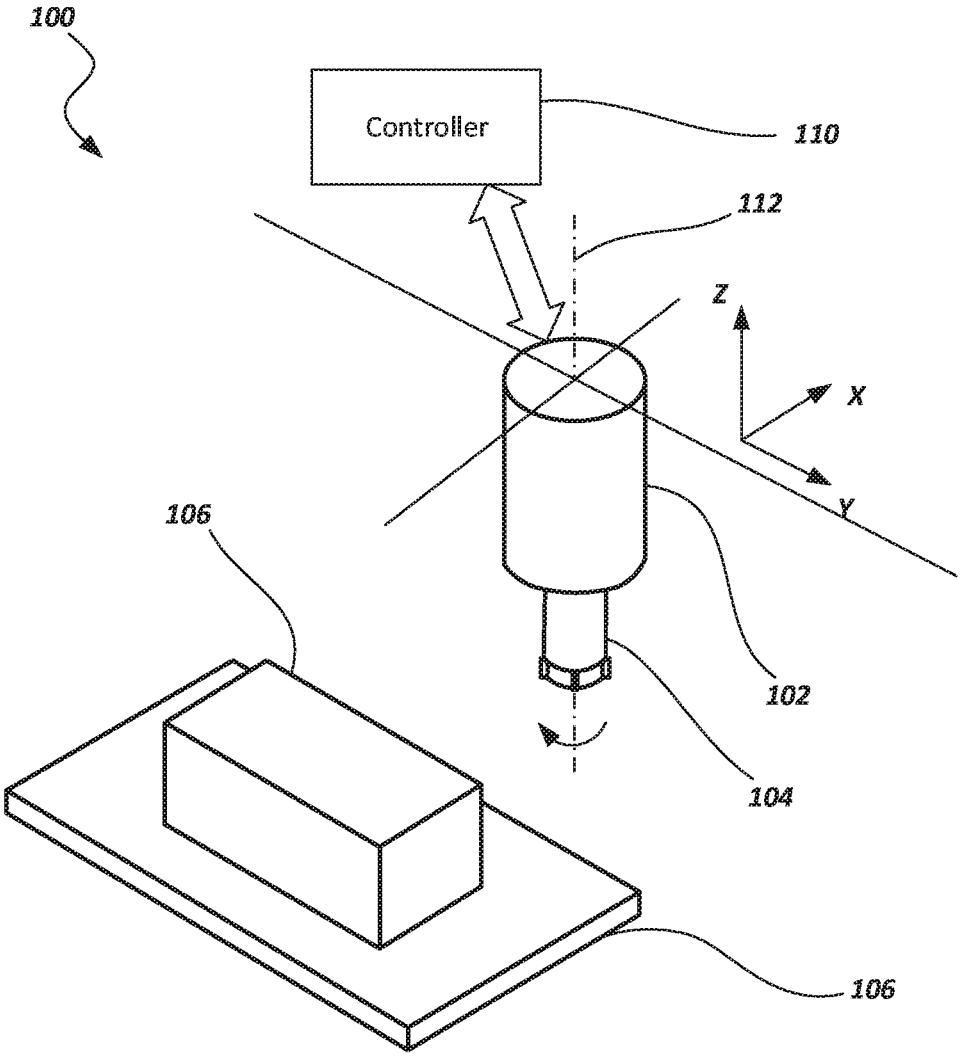
FIG. 1 is a schematic drawing showing a milling operation according to one embodiment of the present disclosure.

Referring to FIG. 1, an example of the operation of a vertical milling machine (VMM) 100 is schematically shown. The VMM 100 includes a spindle 102 having a cutting tool 104 removably coupled therewith in accordance with an embodiment of the present disclosure. The VMM 100 also includes a table 106 on which a workpiece 108 is placed. A CNC (computer numerically controlled) controller 110 is in communication with the spindle 102 and may control the action of the spindle 102. While not expressly shown in FIG. 1, a frame may couple several of the components together (e.g., the spindle 102 and the table 106). The spindle 102 is configured to rotate the cutting tool 104 about an axis 112 and to also move the cutting tool 104 in the X, Y and Z directions relative to the table 106 and associated workpiece 108.

As noted above, the controller 110 is in communication with the spindle 102 and configured to control various operations of the VMM 100. For example, the controller 110 may be configured to control the rotational speed of the cutting tool 104 and also move the spindle 102 (and, thus, the cutting tool 104) in specified directions along the X-Y-Z axes at a desired "feed rate" relative to the workpiece 108. Thus, the controller 110 may enable the cutting tool 104 to remove material from the workpiece 108 so as to shape it and provide a desired surface finish to the workpiece 108 as will be appreciated by those of ordinary skill in the art.

Figure 2:
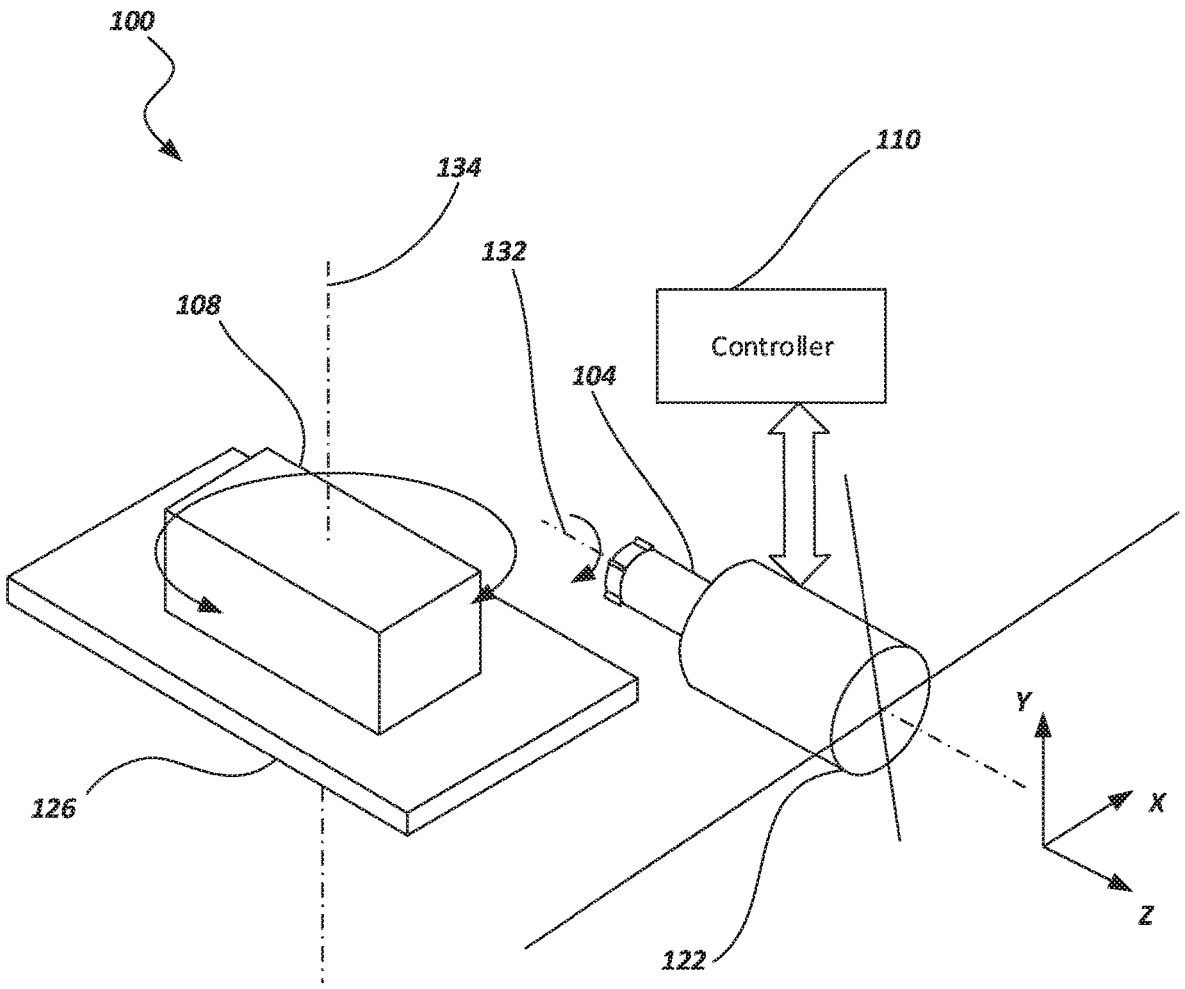
FIG. 2 is a schematic drawing showing a milling operation according to another embodiment of the present disclosure.

Referring to FIG. 2, an example of the operation of a horizontal milling machine (HMM) 120 is schematically shown. The HMM 120 includes a spindle 122 having a cutting tool 104 removably coupled therewith in accordance with an embodiment of the present disclosure. The HMM 120 also includes a table 126 on which a workpiece 108 is placed. The table 126 may be vertically oriented. A CNC controller 110 is in communication with the spindle 102 and controls the action of the spindle 122. In one embodiment, the controller 110 may also be in communication with the table 126 and/or spindle 122 to displace one or both in a desired direction, respectively, as discussed below. While not expressly shown in FIG. 2, a frame may couple several of the components together (e.g., the spindle 122 and the table 126). The spindle 122 is configured to rotate the cutting tool 104 about an axis 132 and to also move the cutting tool 104 in the X, Y and Z directions relative to the table 126 and the associated workpiece 108. Additionally, the table 126 may be configured to rotate about a B-axis 134, which is substantially orthogonal to the rotational axis 132. In one embodiment, the controller 110 may be configured to control the rotational speed of the cutting tool 104, displace the spindle 102 (and, thus, the cutting tool 104) in a specified direction and at a desired "feed rate" relative to the workpiece 108, and also rotate the table 126 (and thus the workpiece 108). Thus, the controller 110 may enable the cutting tool 104 to remove material from the workpiece 108 so as to shape it and provide a desired surface finish to the workpiece 108 as will be appreciated by those of ordinary skill in the art.

It is noted that the milling machines 100 and 120 described with respect to FIGS. 1 and 2 are merely examples, and that a variety of other machining systems are contemplated as incorporating a cutting tool such as is described in further detail below for use in a variety of machining operations.

Figure 3:
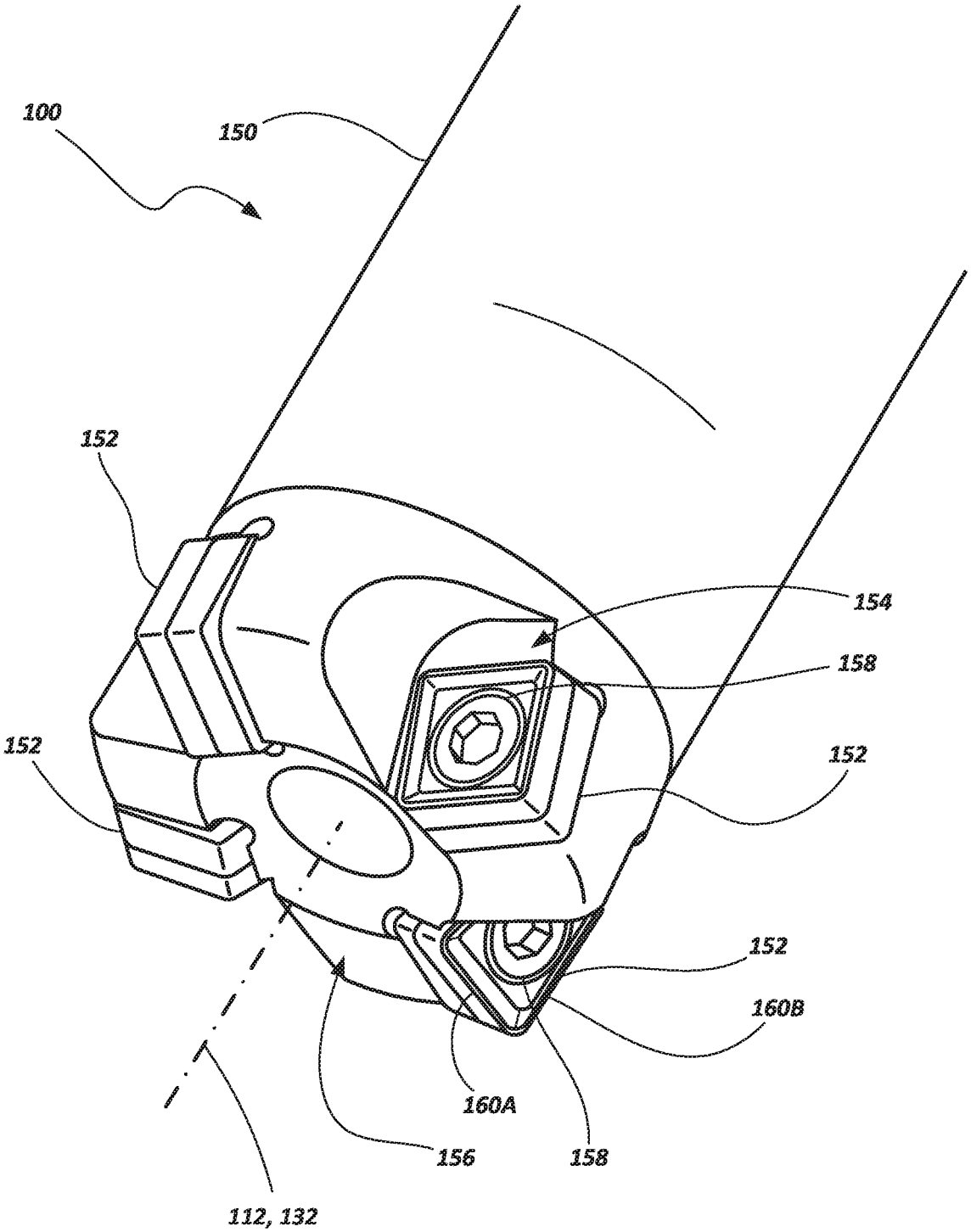
FIGS. 3 and 4 are perspective and side views of a cutting tool in accordance with an embodiment of the present disclosure.
Figure 4:
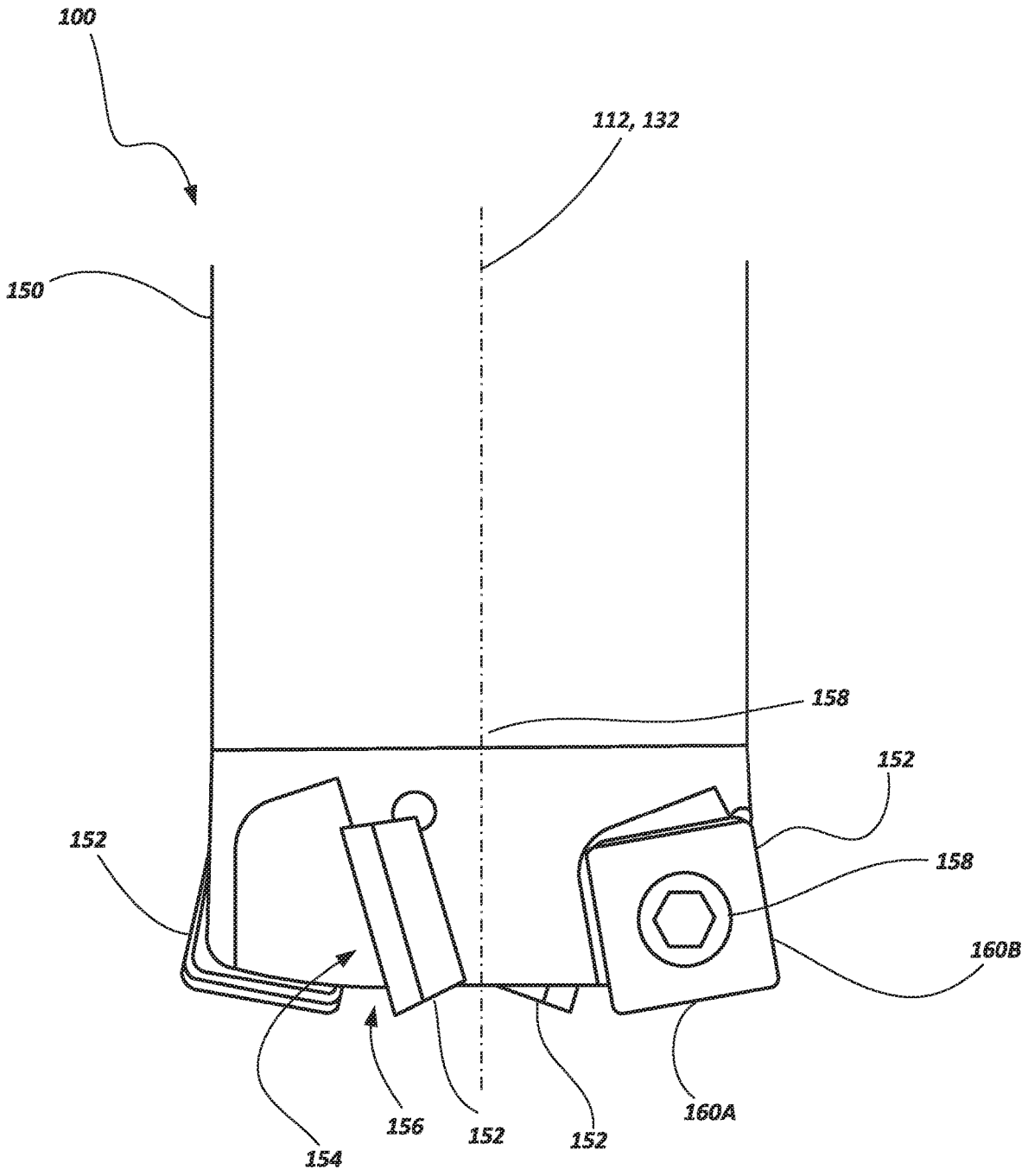

Referring now to FIGS. 3 and 4, a cutting tool 104 is shown having a tool body 150 and a plurality of cutting elements or inserts 152. The cutting elements 152 may be disposed in pockets 154 formed in an end or region of the body 156. In some embodiments, the cutting elements may be removably coupled with the tool body 150 such as by a fastener 158. In some embodiments, the cutting elements 152 may be indexable relative to the tool body 150. Thus, for example, as one face 160A or edge of a given cutting element 152 becomes worn or damaged, the cutting element 152 may be rotated relative to the tool body 150 such that a new face or edge 160B may be presented to a workpiece for the cutting and removal of material therefrom. In some embodiments, the cutting elements 152 may be removably coupled with the body 150 using clamping mechanisms. In some embodiments, the cutting elements 152 may be coupled with the body 150 by brazing or other material joining techniques.

Various materials may be used in forming the body 150 of the cutting tool including various metals and metal alloys. In some embodiments, the body 150 may be formed of an aluminum or aluminum alloy material. Other materials that may be used in forming the tool body include, without limitation, steel and steel alloys (e.g. stainless steels), nickel and nickel alloys, titanium and titanium alloys, tungsten and tungsten alloys, tungsten carbide and associated alloys, and other metals.

In some embodiments, the cutting elements 152 may be formed of superhard, superabrasive materials. For example, the cutting elements 152 may include polycrystalline cubic boron nitride, polycrystalline diamond or other superabrasive materials. For example, referring to FIGS. 5-7 the cutting elements 152 may include a superhard, superabrasive table 170 defining the working surface 172. In some embodiments, the cutting element 152 may comprise a polycrystalline diamond compact ("PDC") including a polycrystalline diamond ("PCD") table to which the substrate 174 is bonded. In some embodiments, the interface between the table 170 and the substrate 174 may be substantially flat or planar. In other embodiments, the interface may be domed or curved. In other embodiments, the interface between the table 170 and the substrate 174 may include a plurality of raised features or recessed features (e.g., dimples, grooves, ridges, etc.).

In some embodiments, the substrate 174 may comprise a cobalt-cemented tungsten carbide substrate bonded to the table 170. In one particular example, the table 170 may include a relatively "thick diamond" table which exhibits a thickness (i.e., from the working surface 174 to the interface between the table 170 and the substrate 174) that is approximately 0.04 inch or greater. In other embodiments, the table 170 exhibits a thickness of approximately 0.04 or greater, approximately 0.05 inch or greater, 0.07 inch or greater, 0.09 inch or greater, 0.11 inch or greater, 0.12 inch or greater, 0.15 inch or greater, 0.2 inch or greater or 0.3 inch or greater.

In one embodiment, the table 170 exhibits a thickness between approximately 0.04 inch and approximately 0.07 inch. In one embodiment, the table 170 exhibits a thickness between approximately 0.05 inch and approximately 0.07 inch. In one embodiment, the table 170 exhibits a thickness between approximately 0.07 inch and approximately 0.09 inch. In one embodiment, the table 170 exhibits a thickness between approximately 0.09 inch and approximately 0.11 inch. In one embodiment, the table 170 exhibits a thickness between approximately 0.11 inch and approximately 0.12 inch. In one embodiment, the table 170 exhibits a thickness between approximately 0.12 inch and approximately 0.15 inch. In one embodiment, the table 170 exhibits a thickness between approximately 0.15 inch and approximately 0.2 inch. In one embodiment, the table 170 exhibits a thickness between approximately 0.2 inch and approximately 0.3 inch. Examples of forming relatively thick PDCs for use in bearings and in use of subterranean drilling may be found in U.S. Pat. No. 9,080,385, the disclosure of which is incorporated by reference herein in its entirety.

Figure 8A:
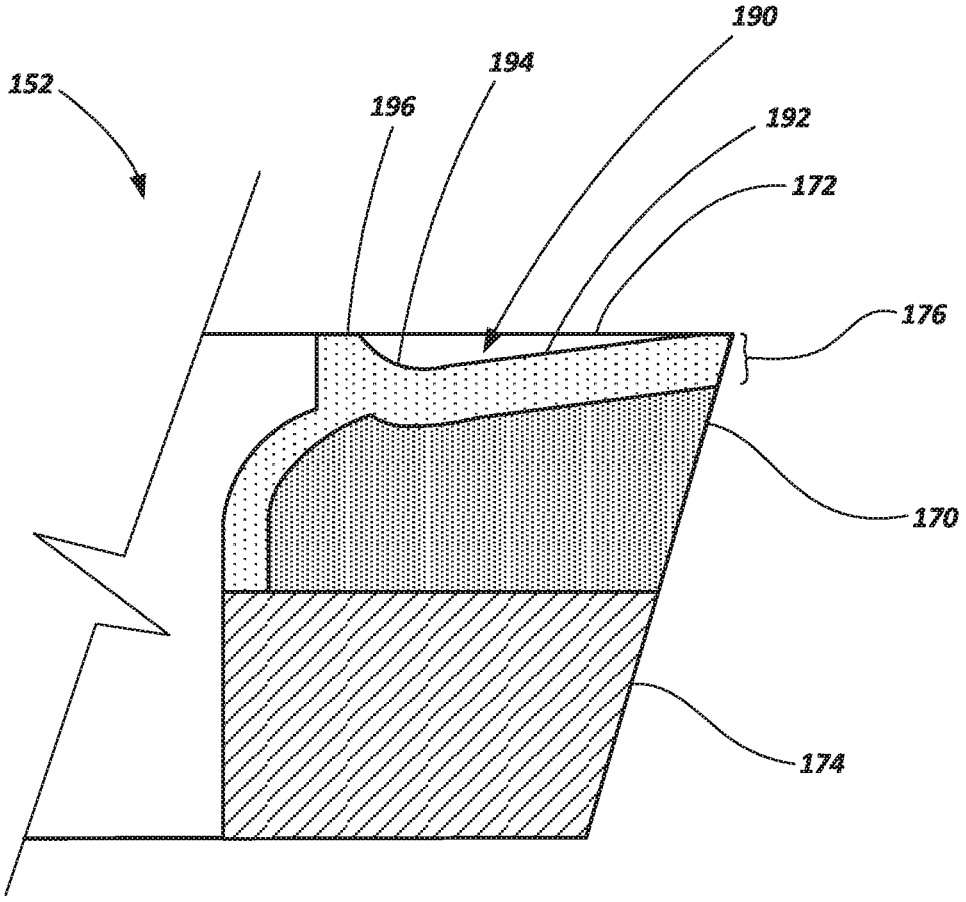
FIGS. 8A and 8B are enlarged views of a portion of the insert shown in FIG. 7 according to embodiments of the present disclosure.
Figure 8B:
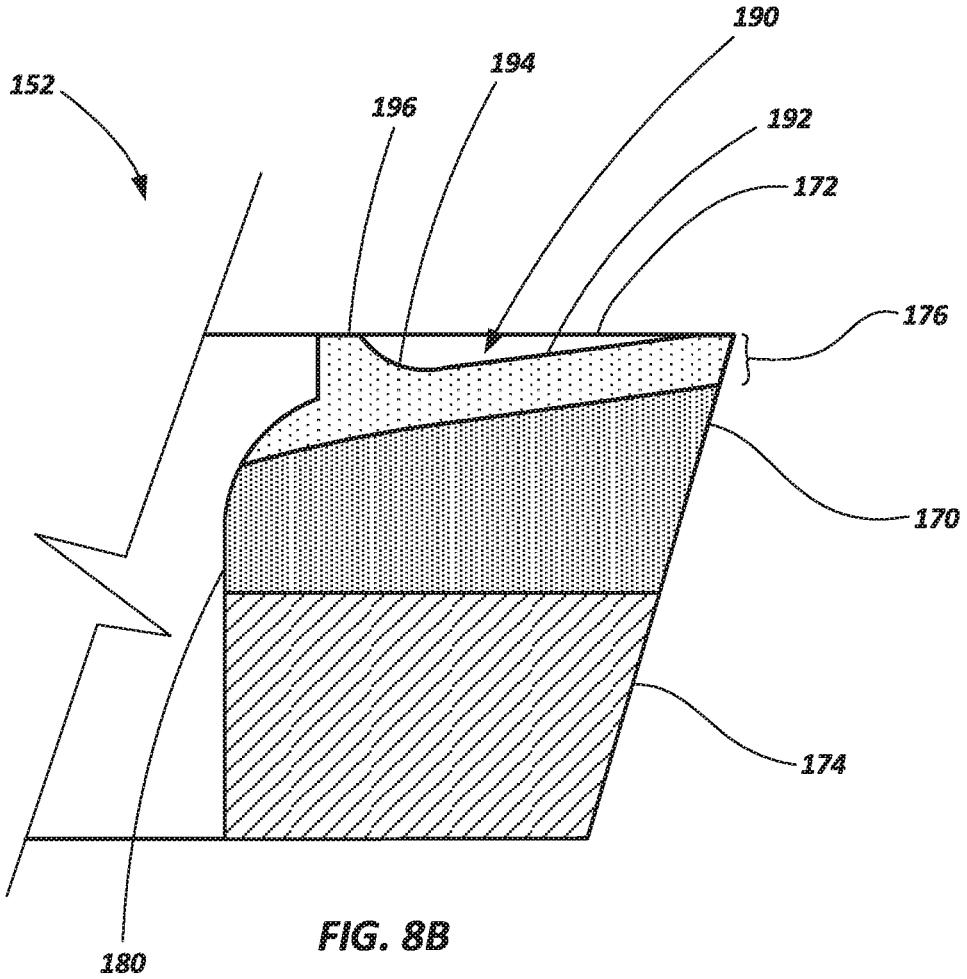

The PCD table 170 includes a plurality of directly bonded-together diamond grains exhibiting diamond-to-diamond bonding therebetween (e.g., sp3 bonding), which define a plurality of interstitial regions. A portion of, or substantially all of, the interstitial regions of the PCD table may include a metal-solvent catalyst or a metallic infiltrant disposed therein that is infiltrated from the substrate 174 or from another source during fabrication. For example, the metal-solvent catalyst or metallic infiltrant may be selected from iron, nickel, cobalt, and alloys of the foregoing. In some embodiments, the PCD table 170 may further include thermally-stable diamond in which the metal-solvent catalyst or metallic infiltrant has been partially or substantially completely depleted (e.g., region 176 shown in FIGS. 8A and 8B) from a selected surface or volume of the PCD table, such as via an acid leaching process. Thermally-stable PCD may also be sintered with one or more alkali metal catalysts. In some embodiments, the catalyst-depleted region 176 may exhibit a depth that is substantially conformal with an outer surface of the PCD table 170, such as shown in FIGS. 8A and 8B. In other embodiments, the catalyst-depleted region 176 may generally extend a desired depth from a plane extending through the uppermost portions of the table 170 (e.g., through the peripheral edges of the working surface 172 and/or through the upper surface of the lip 196—see FIG. 8A). Thus, removal of the catalyst or infiltrant may be done prior to or after the forming of the structures and features (e.g., chip breakers 190, opening 180, etc. as described hereinbelow). For example, FIG. 8B shows an embodiment where the removal of catalyst material does not extend substantially into the hole 180. This may be because of selective catalyst removal techniques (e.g., masking), or it may be because the hole 180 was formed after catalyst removal.

In some embodiments, PDCs which may be used as the cutting elements 152 may be formed in an HPHT process. For example, diamond particles may be disposed adjacent to the substrate 174, and subjected to an HPHT process to sinter the diamond particles to form the PCD table and bond the PCD table to the substrate 122, thereby forming the PDC. The temperature of the HPHT process may be at least about 1000° C. (e.g., about 1200° C. to about 1600° C.) and the cell pressure, or the pressure in the pressure-transmitting medium (e.g., a refractory metal can, graphite structure, pyrophyllite, etc.), of the HPHT process may be at least 4.0 GPa (e.g., about 5.0 GPa to about 12 GPa or about 7.5 GPa to about 11 GPa) for a time sufficient to sinter the diamond particles.

In some embodiments, the diamond particles may exhibit an average particle size of about 50 μm or less, such as about 30 μm or less, about 20 μm or less, about 10 μm to about 20 μm, about 10 μm to about 18 μm, about 12 μm to about 18 μm, or about 15 μm to about 18 μm. In some embodiments, the average particle size of the diamond particles may be about 10 μm or less, such as about 2 μm to about 5 μm or submicron. In some embodiments, the diamond particles may exhibit multiple sizes and may comprise, for example, a relatively larger size and at least one relatively smaller size. As used herein, the phrases "relatively larger" and "relatively smaller" refer to particle sizes (by any suitable method) that differ by at least a factor of two (e.g., 30 μm and 15 μm). According to various embodiments, the mass of diamond particles may include a portion exhibiting a relatively larger size (e.g., 30 μm, 20 μm, 15 μm, 12 μm, 10 μm, 8 μm) and another portion exhibiting at least one relatively smaller size (e.g., 6 μm, 5 μm, 4 μm, 3 μm, 2 μm, 1 μm, 0.9 μm, 0.8 μm, 0.7 μm, 0.6 μm, 0.5 μm, less than 0.5 μm, 0.4 μm, 0.3 μm, 0.2 μm, 0.1 μm, less than 0.1 μm). For example, in one embodiment, the diamond particles may include a portion exhibiting a relatively larger size between about 10 μm and about 40 μm and another portion exhibiting a relatively smaller size between about 0.5 μm and 4 μm. In some embodiments, the diamond particles may comprise three or more different sizes (e.g., one relatively larger size and two or more relatively smaller sizes), without limitation. The PCD table so-formed after sintering may exhibit an average diamond grain size that is the same or similar to any of the foregoing diamond particle sizes and distributions. More details about diamond particle sizes and diamond particle size distributions that may be employed are disclosed in U.S. Pat. No. 9,346,149, the disclosure of which is incorporated by reference herein in its entirety.

In some embodiments, the diamond grains of the resulting table 170 may exhibit an average grain size that is equal to or less than approximately 12 μm and include cobalt content of greater than about 7 weight percent (wt. %) cobalt. In some other embodiments, the diamond grains of the resulting table 170 may exhibit an average grain size that is equal to or greater than approximately 20 μm and include cobalt content of less than approximately 7 wt. %. In some embodiments, the diamond grains of the resulting table may exhibit an average grains size that is approximately 10 μm to approximately 20 μm.

In some embodiments, tables 170 may be formed as PCD tables at a pressure of at least about 7.5 GPa, may exhibit a coercivity of 115 Oe or more, a high-degree of diamond-to-diamond bonding, a specific magnetic saturation of about 15 $G{\cdot}cm^3/g$ or less, and a metal-solvent catalyst content of about 7.5 wt. % or less. The PCD may include a plurality of diamond grains directly bonded together via diamond-to-diamond bonding to define a plurality of interstitial regions. At least a portion of the interstitial regions or, in some embodiments, substantially all of the interstitial regions may be occupied by a metal-solvent catalyst, such as iron, nickel, cobalt, or alloys of any of the foregoing metals. For example, the metal-solvent catalyst may be a cobalt-based material including at least 50 wt. % cobalt, such as a cobalt alloy.

The metal-solvent catalyst that occupies the interstitial regions may be present in the PCD in an amount of about 7.5 wt. % or less. In some embodiments, the metal-solvent catalyst may be present in the PCD in an amount of about 3 wt. % to about 7.5 wt. %, such as about 3 wt. % to about 6 wt. %. In other embodiments, the metal-solvent catalyst content may be present in the PCD in an amount less than about 3 wt. %, such as about 1 wt. % to about 3 wt. % or a residual amount to about 1 wt. %. By maintaining the metal-solvent catalyst content below about 7.5 wt. %, the PCD may exhibit a desirable level of thermal stability.

Generally, as the sintering pressure that is used to form the PCD increases, the coercivity may increase and the magnetic saturation may decrease. The PCD defined collectively by the bonded diamond grains and the metal-solvent catalyst may exhibit a coercivity of about 115 Oe or more and a metal-solvent catalyst content of less than about 7.5 wt. % as indicated by a specific magnetic saturation of about 15 $G{\cdot}cm^3/g$ or less. In a more detailed embodiment, the coercivity of the PCD may be about 115 Oe to about 250 Oe and the specific magnetic saturation of the PCD may be greater than 0 $G{\cdot}cm^3/g$ to about 15 $G{\cdot}cm^3/g$. In an even more detailed embodiment, the coercivity of the PCD may be about 115 Oe to about 175 Oe and the specific magnetic saturation of the PCD may be about 5 $G{\cdot}cm^3/g$ to about 15 $G{\cdot}cm^3/g$. In yet an even more detailed embodiment, the coercivity of the PCD may be about 155 Oe to about 175 Oe and the specific magnetic saturation of the PCD may be about 10 $G{\cdot}cm^3/g$ to about 15 $G{\cdot}cm^3/g$. The specific permeability (i.e., the ratio of specific magnetic saturation to coercivity) of the PCD may be about 0.10 or less, such as about 0.060 to about 0.090. Despite the average grain size of the bonded diamond grains being less than about 30 μm, the metal-solvent catalyst content in the PCD may be less than about 7.5 wt. % resulting in a desirable thermal stability.

In one embodiment, diamond particles having an average particle size of about 18 μm to about 20 μm are positioned adjacent to a cobalt-cemented tungsten carbide substrate and subjected to an HPHT process at a temperature of about 1390° C. to about 1430° C. and a cell pressure of about 7.8 GPa to about 8.5 GPa. The PCD so-formed as a PCD table bonded to the substrate may exhibit a coercivity of about 155 Oe to about 175 Oe, a specific magnetic saturation of about 10 $G{\cdot}cm^3/g$ to about 15 $G{\cdot}cm^3/g$, and a cobalt content of about 5 wt. % to about 7.5 wt. %.

In one or more embodiments, a specific magnetic saturation constant for the metal-solvent catalyst in the PCD may be about 185 $G{\cdot}cm^3/g$ to about 215 $G{\cdot}cm^3/g$. For example, the specific magnetic saturation constant for the metal-solvent catalyst in the PCD may be about 195 $G{\cdot}cm^3/g$ to about 205 $G{\cdot}cm^3/g$. It is noted that the specific magnetic saturation constant for the metal-solvent catalyst in the PCD may be composition dependent.

Generally, as the sintering pressure is increased above 7.5 GPa, a wear resistance of the PCD so-formed may increase. For example, the $G_{ratio}$ may be at least about $4.0\times10^6$, such as about $5.0\times10^6$ to about $15.0\times10^6$ or, more particularly, about $8.0\times10^6$ to about $15.0\times10^6$. In some embodiments, the $G_{ratio}$ may be at least about $30.0\times10^6$. The $G_{ratio}$ is the ratio of the volume of workpiece cut (e.g., between about 470 $in^3$ of bane granite to about 940 $in^3$ of barre granite) to the volume of PCD worn away during the cutting process. It is noted that while such a process may involve a so-called "granite log test," this process is still applicable for determining the $G_{ratio}$ of the PCD even though the cutter may be intended for use in metal cutting processes rather than rock cutting or drilling.

The material characteristics discussed herein, as well as other characteristics that may be provided in a cutting element 152, including processes for measuring and determining such characteristics, as well as methods of making such cutting elements, are described in U.S. Pat. Nos. 7,866,418, 8,297,382, and 9,315,881, the disclosure of each of which is incorporated by reference herein in its entirety.

In some embodiments, the table 170 may comprise high density polycrystalline diamond. For example, in some embodiments, the table 170 may comprise approximately 95 percent diamond by volume (vol. %) or greater. In some embodiments, the table 170 may comprise approximately 98 vol. % diamond or greater. In some embodiments, the table 170 may comprise approximately 99 vol. % diamond or greater. In other embodiments, the table may comprise polycrystalline diamond or relatively low diamond content. For example, in some embodiments, the table 170 may comprise less than 95 percent diamond by volume (vol. %).

In some embodiments, the table 170 may be integrally formed with the substrate 174 such as discussed above. In some other embodiments, the table 170 may be a pre-formed table that has been HPHT bonded to the substrate 174 in a second HPHT process after being initially formed in a first HPHT process. For example, the table 170 may be a pre-formed PCD table that has been leached to substantially completely remove the metal-solvent catalyst used in the manufacture thereof and subsequently HPHT bonded or brazed to the substrate 174 in a separate process.

The substrate 174 may be formed from any number of different materials, and may be integrally formed with, or otherwise bonded or connected to, the table 170. Materials suitable for the substrate 174 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof.

However, in some embodiments, the substrate 174 may be omitted and the cutting elements 152 may include a superhard, superabrasive material, such as a polycrystalline diamond body that has been leached to deplete the metal-solvent catalyst therefrom or that may be an unleached PCD body.

As discussed above, in some embodiments, the table 170 may be leached to deplete a metal-solvent catalyst or a metallic infiltrant therefrom in order to enhance the thermal stability of the table 170. For example, when the table 170 is a PCD table, the table 170 may be leached to remove at least a portion of the metal-solvent catalyst, that was used to initially sinter the diamond grains to form a leached thermally-stable region 176, from a working region thereof to a selected depth. The leached thermally-stable region may extend inwardly from the working surface 174 to a selected depth. In an embodiment, the depth of the thermally-stable region may be about 50 μm to about 1,500 μm. More specifically, in some embodiments, the selected depth is about 50 μm to about 900 μm, about 200 μm to about 600 μm, or about 600 μm to about 1200 μm. The leaching may be performed in a suitable acid, such as aqua regia, nitric acid, hydrofluoric acid, or mixtures of the foregoing.

Figure 5:
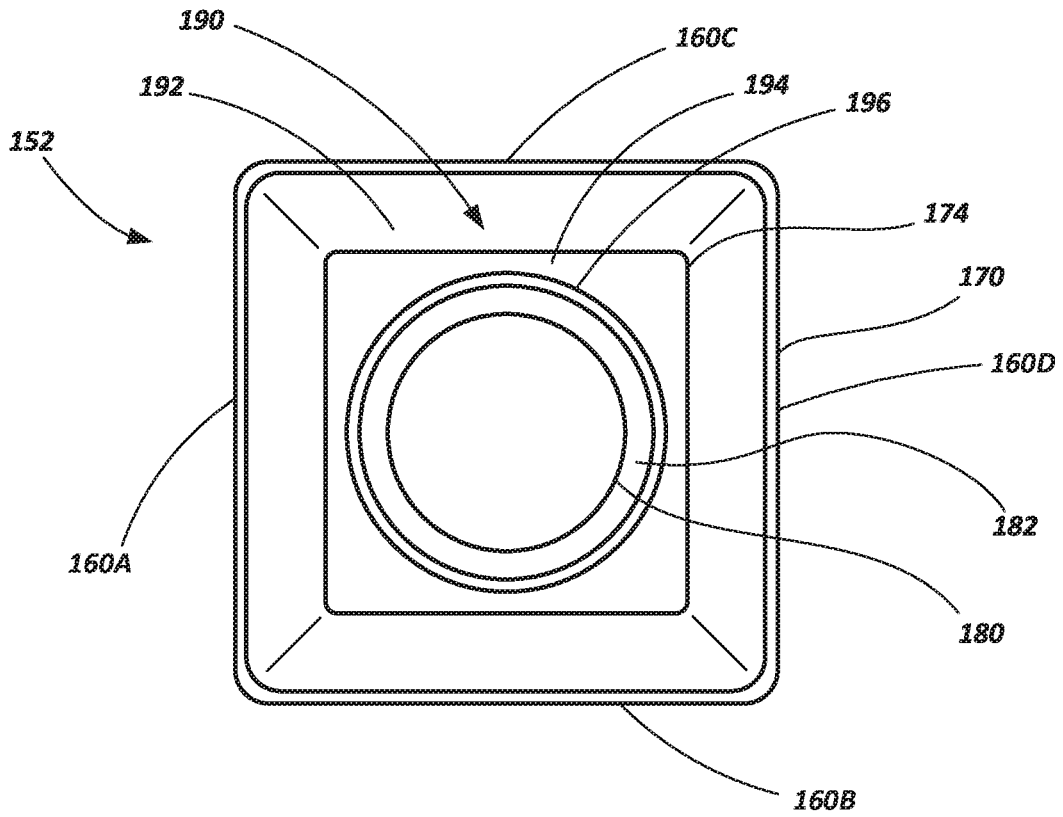
FIGS. 5 and 6 are top and side views of a cutting insert according to an embodiment of the present disclosure.

As depicted in FIGS. 3-7, the cutting elements 152 may be configured to exhibit a substantially square outer profile when viewed from above (i.e., as seen specifically in FIG. 5). Such a geometry provides multiple cutting edges 160A-160D which may be indexed relative to a cutting tool body 150 for extended service of the cutting elements 152. However, it is noted that other shapes and outer profiles are contemplated including, for example, circular, curved, triangular, hexagonal, octagonal, and other regular or irregular polygons.

Figure 6:
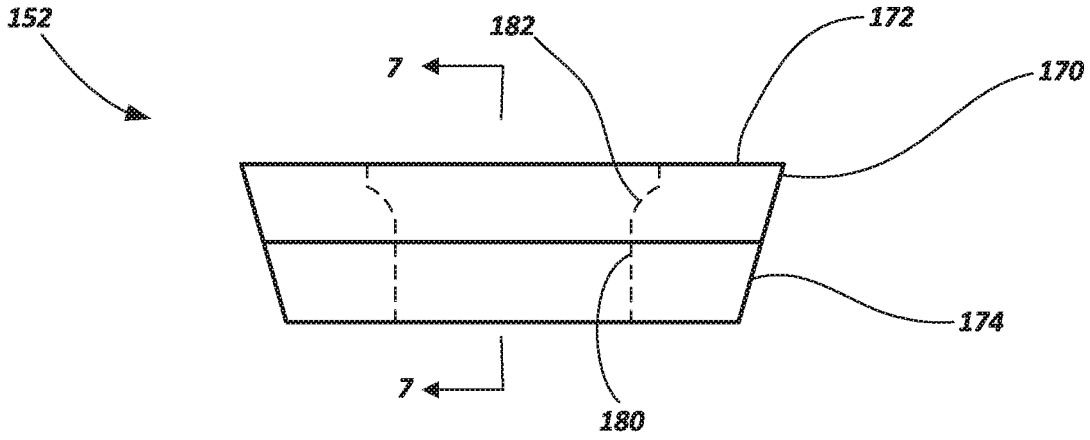
Figure 7:
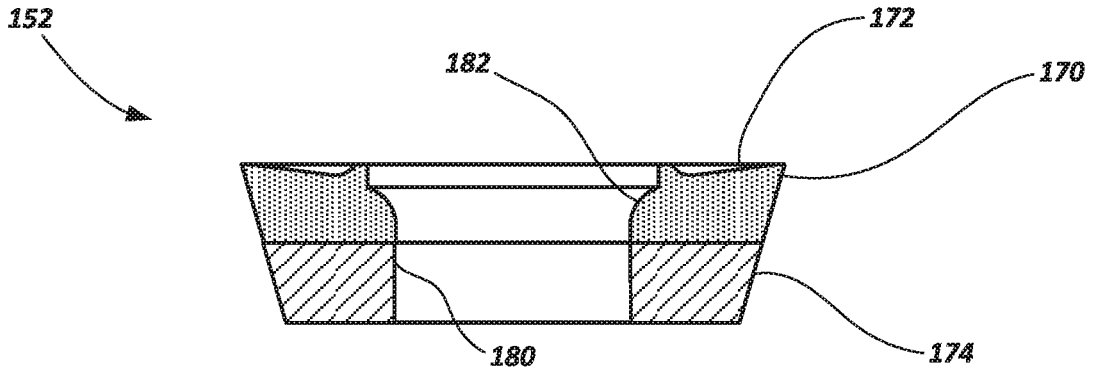
FIG. 7 is a cross-sectional view taken along lines 7-7 as indicated in FIG. 6.

As seen in FIGS. 5 and 6, the cutting elements 152 may also include an opening 180 formed in the table 170 and substrate 174 to accommodate a fastener for coupling of the cutting element 152 with a cutting tool body 150. The opening 180 may include a countersunk region 182 (or a counter bore, depending on the type of fastener being used) to enable a fastener to be positioned flush with or below the working surface 172 of the table 170 when the cutting element 152 is coupled with a cutting tool body 150.

It is noted that other features may be provided in the cutting elements 152 including, for example, features for breaking chips of material that are being removed from the workpiece when engaged by the rotating cutting tool 104. For example, as seen best in FIGS. 5 and 8, the cutting elements may include formations or structures referred to as chip breakers 190. The chip breakers 190 may include a declining ramped surface portion 192 formed within the table 170 extending radially inward from a location adjacent the outer periphery of the table 170. The chip breaker 190 may further include a portion that is angled or curved, referred to as a return portion 194, that leads up to a protruding lip 196 positioned adjacent to and surrounding the opening 180. As material is removed from a workpiece, the removed material travels along the ramped surface portion 192 and then abruptly changes directions as it encounters the return portion 194, promoting the breaking of the removed material into smaller "chips." Breaking the material removed from a workpiece into smaller, discrete chips, instead of allowing the removed material to remain as long strings, helps to reduce potential interference of the removed material with the ongoing machining process.

It is noted that other configurations of chip breakers may be incorporated into the cutting elements 152, including discrete, discontinuous breakers formed adjacent individual cutting faces 160A-160D. Other non-limiting examples of features and configurations that may assist with chip breaking include those described in U.S. Pat. No. 9,278,395, the disclosure of which is incorporated by reference herein in its entirety.

Various methods may be employed to form the opening 180, countersunk region 182, chip breaker 190, or other geometric features, including processes such as laser machining and laser cutting. Some non-limiting methods of forming such features in the cutting element are described in U.S. Pat. Nos. 9,089,900, 9,062,505, and PCT Patent Application No. PCT/US2018/013069 (entitled ENERGY MACHINED POLYCRYSTALLINE DIAMOND COMPACTS AND RELATED METHODS, filed on Jan. 10, 2018) the disclosure of each of which documents is incorporated by reference herein in its entirety. Additionally, the cutting elements 152 may be subjected to other processes to obtain desired characteristics or features. For example, at least a portion of a surface of the table 170 may be polished (e.g., at least a portion of a PCD surface may be polished) to a finish of approximately 20 micro inches (μ in) root mean square (RMS). Examples of surface finishing processes and tables with various surface finishes are described in U.S. patent application Ser. No. 15/232,780, (entitled ATTACK INSERTS WITH DIFFERING SURFACE FINISHES, ASSEMBLIES, SYSTEMS INCLUDING SAME, AND RELATED METHODS, filed Aug. 9, 2016) the disclosure of which is incorporated by reference herein in its entirety.

While the cutting elements 152 and the cutting tool 104 may be used in a variety of machining processes, and for machining of a variety of materials, it has been determined that use of cutting elements 152 having a PCD table 170 combined with a tool body 150 formed of a material comprising aluminum unexpectedly provides various benefits when machining a workpiece formed of titanium. While the exact mechanisms for improved efficiency and effectiveness of the machining of titanium are not entirely understood, it is believed that the use of an aluminum tool body may provide compliance, that such a configuration may provide enhanced thermal conductivity of the cutting tool, or some combination of the two characteristics may result in an enhanced performance of the machining process.

In some embodiments, the cutting elements may be beneficial in machining other thermal resistance materials. For example, in some embodiments, the cutting elements 152 of the present disclosure may provide advantages in machining materials having a thermal conductivity of less than approximately 50 watts per meter-Kelvin (W/m·K). In some embodiments, the cutting elements 152 of the present disclosure may be beneficial in machining materials having a thermal conductivity of less than approximately 30 W/m·K. In some embodiments, the cutting elements 152 of the present disclosure may be beneficial in machining materials having a thermal conductivity of less than approximately 20 W/m·K.

Figure 9:
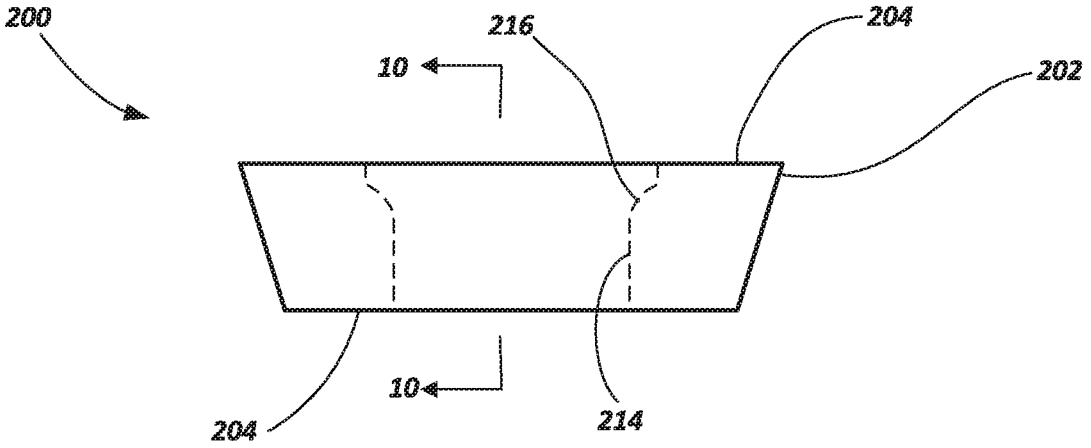
FIG. 9 is a side view of a cutting insert according to an embodiment of the present disclosure.
Figure 10:
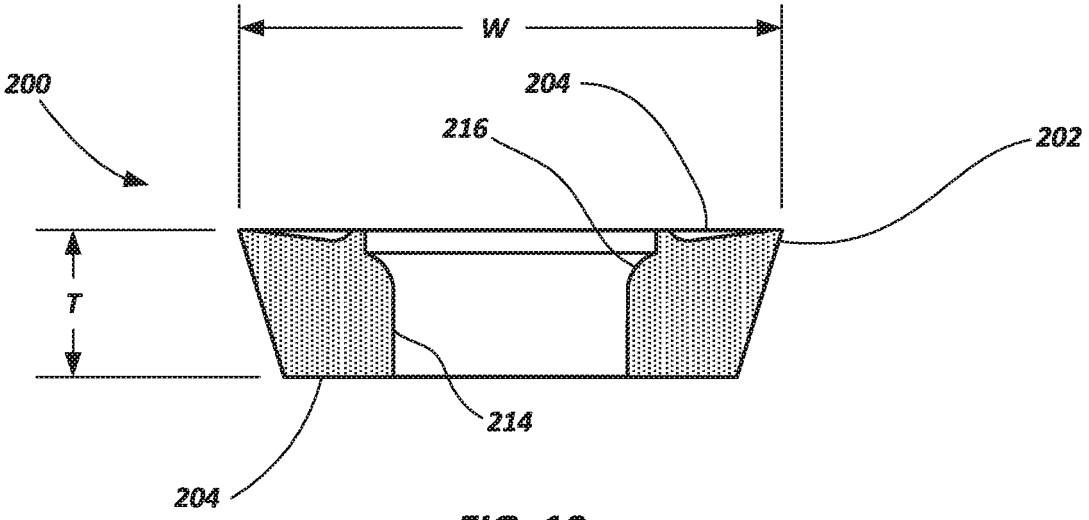
FIG. 10 is a cross-sectional view taken along lines 10-10 as indicated in FIG. 9.

Referring now to FIGS. 9-11, a cutting element 200 according to another embodiment of the present disclosure is provided. The cutting element 200 may be formed of superhard, superabrasive materials. For example, the cutting element 200 may include polycrystalline cubic boron nitride, polycrystalline diamond and/or other superabrasive materials. As with previously described embodiments, the cutting element 200 may include a superhard, superabrasive table 202 defining the working surface 204. In some embodiments, the cutting element 200 may comprise a PCD table 202 with no substrate or other structure attached thereto. In other words, in some embodiments, as previously noted, the cutting element 200 may consist of, or it may consist essentially of a superhard, superabrasive table, such as a PCD table 202. In such an embodiment, the table may be initially formed with a substrate during an HPHT process (with the substrate providing a catalytic material such as previously described), and the substrate may be removed after the HPHT process. In other embodiments, the table 202 may be formed by mixing a catalytic material with diamond powder or otherwise providing a catalytic material prior to an HPHT process.

In one particular example, the table 202 may include a relatively "thick diamond" table which exhibits a thickness (i.e., from the working surface 204 to the lower, opposing surface 206) that is approximately 0.15 inch or greater. In other embodiments, the table 202 exhibits a thickness of approximately 0.2 inch or greater or 0.3 inch or greater. In yet other embodiments, the table may exhibit a lesser thickness (e.g., 0.1 inch, 0.05 inch or less).

In one embodiment, the table 202 exhibits a thickness between approximately 0.05 inch and approximately 0.1 inch. In one embodiment, the table 202 exhibits a thickness between approximately 0.1 inch and approximately 0.15 inch. In one embodiment, the table 202 exhibits a thickness between approximately 0.15 inch and approximately 0.4 inch. In one embodiment, the table 202 exhibits a thickness between approximately 0.15 inch and approximately 0.2 inch. In one embodiment, the table 202 exhibits a thickness between approximately 0.2 inch and approximately 0.3 inch. In one embodiment, the table 202 exhibits a thickness between approximately 0.3 inch and approximately 0.4 inch. In one embodiment, the table 202 exhibits a thickness between approximately 0.4 inch and approximately 0.5 inch. In one embodiment, the table 202 exhibits a thickness between approximately 0.5 inch and approximately 0.6 inch. In one embodiment, the table 202 exhibits a thickness between approximately 0.6 inch and approximately 0.7 inch. In one embodiment, the table 202 exhibits a thickness between approximately 0.7 inch and approximately 0.8 inch. In one embodiment, the table 202 exhibits a thickness between approximately 0.8 inch and approximately 0.9 inch. In one embodiment, the table 202 exhibits a thickness between approximately 0.9 inch and approximately 1 inch. In one embodiment, the table 202 exhibits a thickness between approximately 0.15 inch and approximately 0.3 inch.

As depicted in FIGS. 9-11, the cutting elements 200 may be configured to exhibit a substantially square outer profile when viewed from above (i.e., as seen specifically in FIG. 5). Such a geometry provides multiple cutting edges which may be indexed relative to a cutting tool body 150 for extended service of the cutting elements 200. In one embodiment, the cutting element 200 may have a face that exhibits a substantially square profile that exhibits a width W of approximately 0.5 inch to 0.7 inch. In another embodiment, the width W may be approximately 0.4 inch to 0.8 inch. In another embodiment, the width W may be approximately 0.3 inch to 0.9 inch. In another embodiment, the width W may be approximately 0.2 inch to 0.75 inch. In another embodiment, the width W may be approximately 0.75 inch to 1 inch. In another embodiment, the width W may be approximately 0.37 inch. In another embodiment, the width W may be approximately 0.47 inch. In some embodiments, the square profile may include rounded or chamfered corners or transitions between sides.

As previously noted, other shapes and outer profiles are contemplated including, for example, circular, curved, triangular, rhombus, hexagonal, octagonal, and other regular or irregular polygons.

As seen in FIGS. 9 and 10, the cutting elements 200 may also include an opening 214 formed in the table 202 to accommodate a fastener and/or a clamping element for coupling of the cutting element 200 with a cutting tool body 150. The opening 214 may include a countersunk region 216 (or a counter bore, depending on the type of fastener being used) to enable a fastener and/or clamping element to be positioned flush with or below the working surface 204 of the table 202 when the cutting element 200 is coupled with a cutting tool body 150.

It is noted that other features may be provided in the cutting elements 200 including, for example, features for breaking chips of material that are being removed from the workpiece when engaged by the rotating cutting tool 100. For example, the cutting elements may include formations or structures referred to as chip breakers as has been previously described.

The table 202 may be formed in accordance with methods and techniques previously described herein and may include features and characteristics similar to those described herein with respect to other embodiments.

Figure 11A:
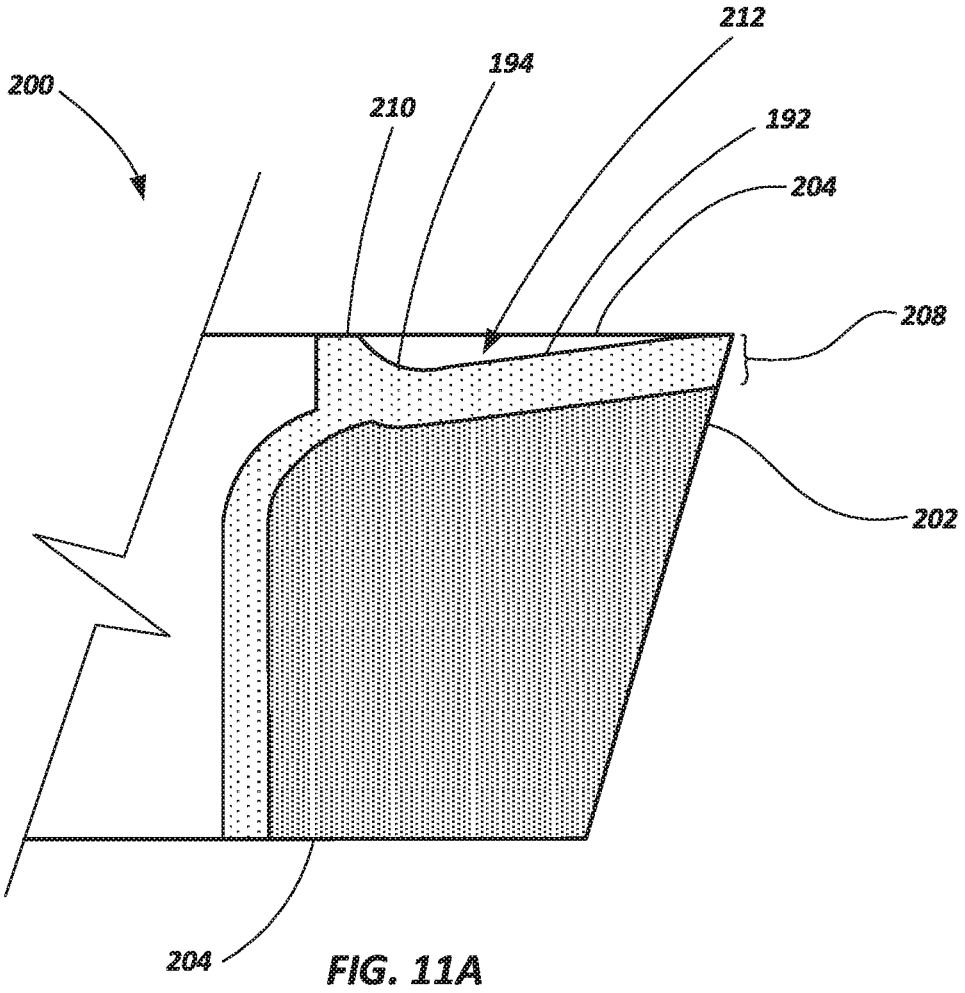
FIGS. 11A-11C are enlarged views of a portion of the insert shown in FIG. 10 according to embodiments of the present disclosure.
Figure 11B:
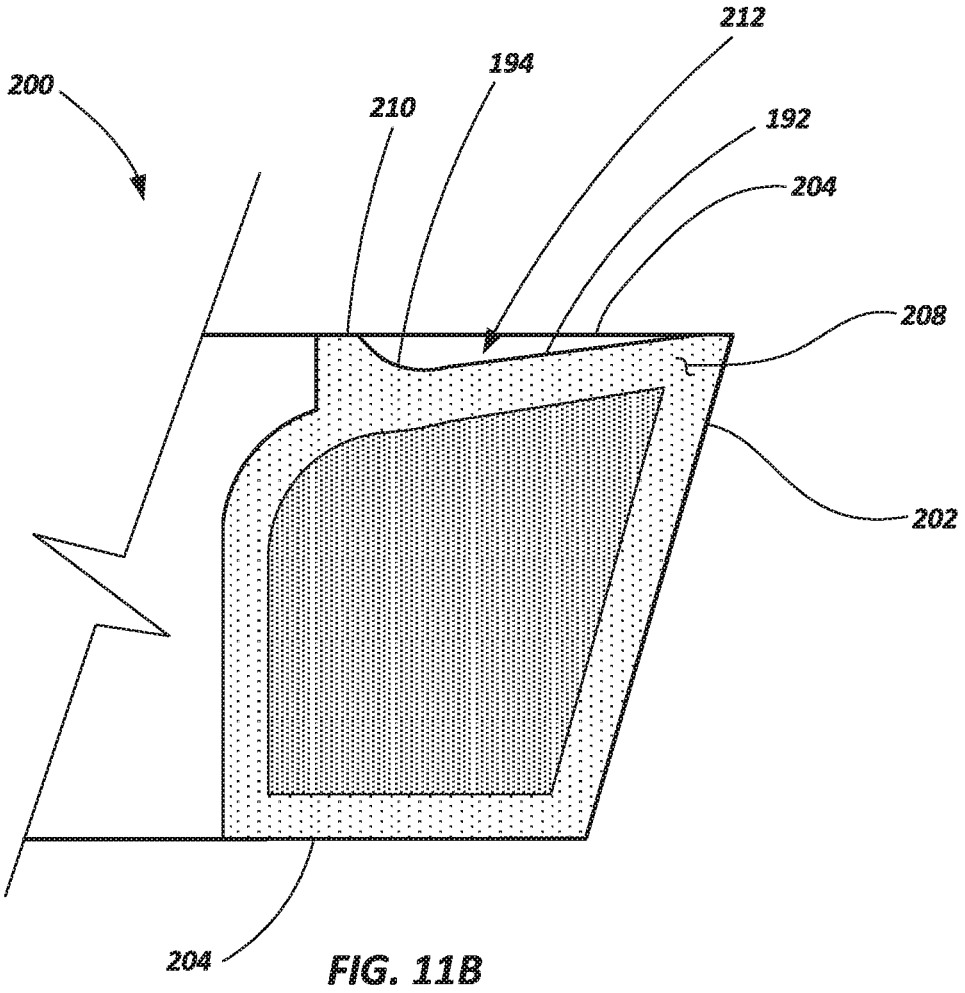
Figure 11C:
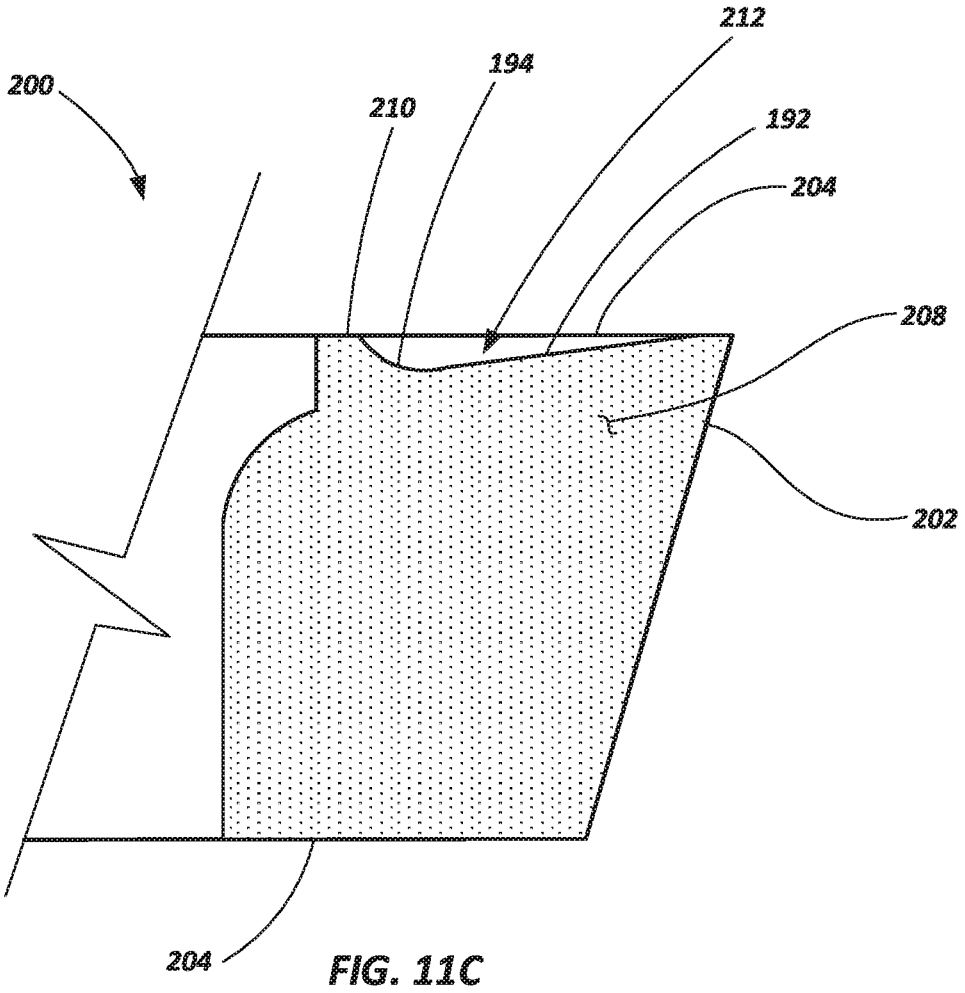

For example, the PCD table 202 may include a plurality of directly bonded-together diamond grains exhibiting diamond-to-diamond bonding therebetween (e.g., sp3 bonding), which define a plurality of interstitial regions. A portion of, or substantially all of, the interstitial regions of the PCD table may include a metal-solvent catalyst or a metallic infiltrant disposed therein that is infiltrated from a substrate or from another source during fabrication. For example, the metal-solvent catalyst or metallic infiltrant may be selected from iron, nickel, cobalt, and alloys of the foregoing. In some embodiments, the PCD table 202 may further include thermally-stable diamond in which the metal-solvent catalyst or metallic infiltrant has been partially or substantially completely depleted (e.g., region 208 shown in FIGS. 11A-11C) from a selected surface or volume of the PCD table, such as via an acid leaching process. Thermally-stable PCD may also be sintered with one or more alkali metal catalysts. In some embodiments, a catalyst-depleted region 208 may exhibit a depth that is substantially conformal with an outer surface of the PCD table 202, such as shown in FIGS. 11A and 11B. In other embodiments, the catalyst-depleted region 208 may generally extend a desired depth from a plane extending through the uppermost portions of the table 202 (e.g., through the peripheral edges of the working surface 204 and/or through the upper surface of the lip 210). Thus, removal of the catalyst or infiltrant may be done prior to or after the forming of the structures and features (e.g., chip breakers 212, opening 214, etc.). As previously noted, in some embodiments, catalyst material may be removed from substantially the entire PCD table 202, such as shown in FIG. 11C.

As discussed above, in some embodiments, the table 202 may be leached to deplete a metal-solvent catalyst or a metallic infiltrant therefrom in order to enhance the thermal stability of the table 202. For example, when the table 202 is a PCD table, the table 202 may be leached to remove at least a portion of the metal-solvent catalyst that was used to initially sinter the diamond grains to form a leached thermally-stable region 208, from a working region thereof to a selected depth. The leached thermally-stable region may extend inwardly from the working surface 206 to a selected depth. In an embodiment, the depth of the thermally-stable region may be about 30 μm to about 1,500 μm. More specifically, in some embodiments, the selected depth is about 50 μm to about 900 μm, about 200 μm to about 600 μm, or about 600 μm to about 1200 μm. The leaching may be performed in a suitable acid, such as aqua regia, nitric acid, hydrofluoric acid, or mixtures of the foregoing.

Figure 12:
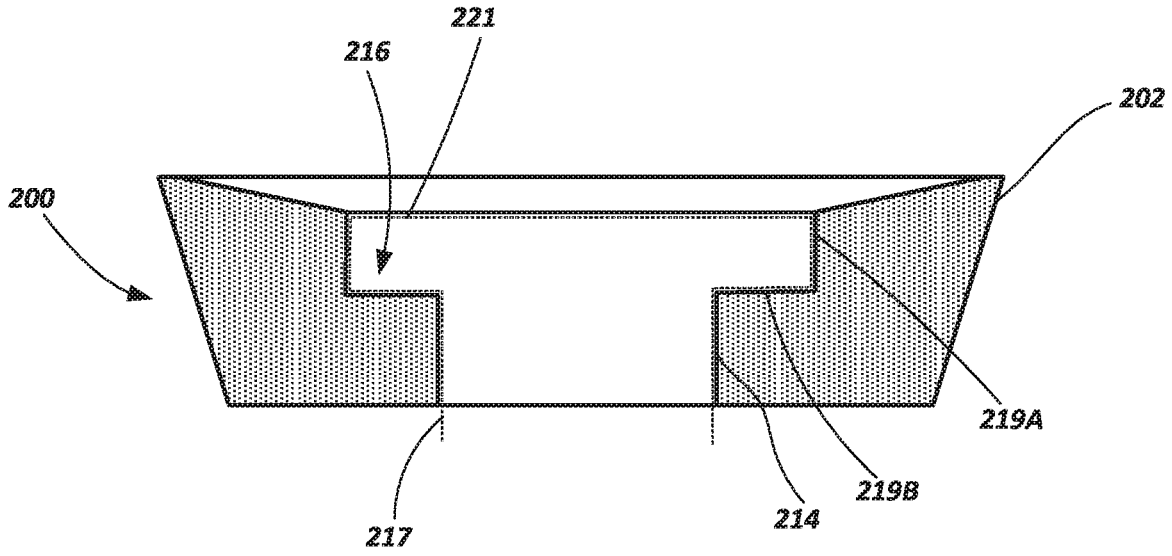
FIG. 12 is a cross-section view, similar to the view shown in FIG. 10, according to another embodiment of the present disclosure.

Referring briefly to FIG. 12, a cutting element 200 is shown with a different cross-sectional profile. The cutting element 200 may include features and aspects such as described hereinabove with respect to other embodiments. For example, the cutting element 200 may include an opening 214 formed in a table 202 to accommodate a fastener and/or a clamping element for coupling of the cutting element 200 with a cutting tool body 150. The opening 214 may include a countersunk region 216 (or a counter bore, depending on the type of fastener 217 being used) to enable a fastener and/or clamping element to be positioned flush with or below the working surface 204 of the table 202 when the cutting element 200 is coupled with a cutting tool body 150. In the embodiment shown in FIG. 12, the countersunk region 216 includes a counterbore which may be formed, in the profile shown, to provide a wall 219A and a floor 219B formed substantially at right angles relative to each other, and configured to accept the head 221 of a fastener 217. The fastener 217, including the head 221 of the fastener, may be configured to, at least in part, be substantially congruent with, conformal with, or otherwise correspond in size and shape with the counterbore or countersunk region. For example, as shown, the cross-sectional profile of the head 221 of the fastener 217 correlates or is congruent with the cross-sectional profile of the counterbore region. In other embodiments, for example, both the head of a fastener and the countersunk region by be tapered, stepped, or a combination of geometric shapes or features in a corresponding and at least partially conformal manner.

It is noted that other features may be provided in the cutting element 200 shown in FIG. 12 including, for example, features for breaking chips of material that are being removed from the workpiece when engaged by the rotating cutting tool 100. For example, the cutting element 200 may include formations or structures referred to as chip breakers as has been previously described.

The table 202 may be formed in accordance with methods and techniques previously described herein and may include features and characteristics similar to those described herein with respect to other embodiments.

For example, the PCD table 202 may include a plurality of directly bonded-together diamond grains exhibiting diamond-to-diamond bonding therebetween (e.g., sp3 bonding), which define a plurality of interstitial regions. A portion of, or substantially all of, the interstitial regions of the PCD table may include a metal-solvent catalyst or a metallic infiltrant disposed therein that is infiltrated from a substrate or from another source during fabrication. For example, the metal-solvent catalyst or metallic infiltrant may be selected from iron, nickel, cobalt, and alloys of the foregoing. In some embodiments, the PCD table 202 may further include thermally-stable diamond in which the metal-solvent catalyst or metallic infiltrant has been partially or substantially completely depleted from a selected surface or volume of the PCD table, such as via an acid leaching process. Locations, sizes, depths and configurations of catalyst depleted areas may be formed similar to those described above with respect to other embodiments including removal of catalyst material from substantially the entire table 202.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

The invention claimed is:

1. A cutting tool comprising:

a body configured to be attached to a spindle;

at least one cutting element coupled to the body, the at least one cutting element comprising a superhard table exhibiting a thickness of at least approximately 0.15 inches, wherein the superhard table includes a chip breaking feature.

2. The cutting tool of claim 1, wherein the superhard table comprises polycrystalline diamond.

3. The cutting tool of claim 2, wherein the superhard table includes at least 95 volume percent of polycrystalline diamond.

4. The cutting tool of claim 2, wherein the superhard table includes at least 98 volume percent of polycrystalline diamond.

5. The cutting tool of claim 2, wherein the superhard table is not bonded with a substrate.

6. The cutting tool of claim 2, wherein the polycrystalline diamond exhibits an average grain size of approximately 12 μm or less.

7. The cutting tool of claim 6, wherein a metal-solvent catalyst is present in at least some interstitial regions of the polycrystalline diamond in an amount greater than approximately 7 percent by weight.

8. The cutting tool of claim 7, wherein the metal-solvent catalyst comprises cobalt.

9. The cutting tool of claim 2, wherein the polycrystalline diamond exhibits an average grain size of approximately 20 μm or greater.

10. The cutting tool of claim 9, wherein a metal-solvent catalyst is present in at least some interstitial regions of the polycrystalline diamond in an amount less than approximately 7 percent by weight.

11. The cutting tool of claim 10, wherein the metal-solvent catalyst comprises cobalt.

12. The cutting tool of claim 1, wherein the superhard table exhibits a thickness of at least approximately 0.2 inches.

13. The cutting tool of claim 1, wherein the body comprises aluminum.

14. The cutting tool of claim 1, wherein the superhard table comprises a polycrystalline diamond table having:

a plurality of diamond grains exhibiting diamond-to-diamond bonding therebetween and defining a plurality of interstitial regions;

a metal-solvent catalyst occupying at least a portion of the plurality of interstitial regions, wherein the plurality of diamond grains and the metal-solvent catalyst collectively exhibit a coercivity of about 115 Oersteds ("Oe") to about 175 Oe; and wherein the plurality of diamond grains and the metal-solvent catalyst collectively exhibit a specific magnetic saturation of about 10 Gauss·$cm^3$/grams ("G·$cm^3$/g") to about 15 G·$cm^3$/g.

15. The cutting tool of claim 1, wherein the at least one cutting element is reversibly coupled to the body using a fastener or a clamp.

16. The cutting tool of claim 1, wherein the at least one cutting element includes:

an unleached region including a metal-solvent catalyst present in at least some interstitial regions of the polycrystalline diamond thereof; and a leached region including at least some of a metal-solvent catalyst at least partially removed from at least some of the interstitial regions of the polycrystalline diamond thereof;

wherein a boundary between the unleached region and the leached region substantially corresponds to a profile of the chip breaking feature.

17. The cutting tool of claim 1, wherein the at least one cutting element includes:

an unleached region including a metal-solvent catalyst present in at least some interstitial regions of the polycrystalline diamond thereof; and a leached region including at least some of a metal-solvent catalyst at least partially removed from at least some of the interstitial regions of the polycrystalline diamond thereof;

wherein a boundary between the unleached region and the leached region does not correspond to a profile of the chip breaking feature.

18. The cutting tool of claim 1, wherein the body and the at least one cutting element are configured to at least one of shape, form, or finish a material.

19. A cutting tool comprising:

a body configured to be attached to a spindle;

at least one cutting element coupled to the body, the at least one cutting element consisting essentially of a polycrystalline diamond table exhibiting a thickness of at least approximately 0.15 inch.

20. The cutting tool of claim 19 wherein the at least one cutting element is formed of a material comprising at least approximately 95 volume percent polycrystalline diamond.

21. The cutting tool of claim 20, wherein the polycrystalline diamond table is at least approximately 98 volume percent polycrystalline diamond.

22. The cutting tool of claim 20, wherein the polycrystalline diamond table exhibits a thickness of at least approximately 0.2 inch.

23. A cutting element consisting essentially of:

a superhard table exhibiting a thickness of at least approximately 0.15 inches, the superhard table defining at least one cutting edge, wherein the superhard table includes a chip breaking feature, the chip breaking feature including:

a declining ramped surface portion extending from the at least one cutting edge;

a protruding lip; and a return portion that is angled or curved, the return portion extending from the declining ramped surface portion to the protruding lip.

* * * * *